US008726816B2

(12) United States Patent
Servaes

(10) Patent No.: US 8,726,816 B2
(45) Date of Patent: May 20, 2014

(54) ELEMENT FOR THE STORAGE, TREATMENT AND TRANSPORT OF ARTICLES

(75) Inventor: Jan Servaes, Hoogstraten (BE)

(73) Assignee: Parnass, besloten vennootschap met beperkte aansprakelijkheid, Hoogstraten (BM)

( * ) Notice: Subject to any disclaimer, the term of this patent is extended or adjusted under 35 U.S.C. 154(b) by 0 days.

(21) Appl. No.: 13/821,385

(22) PCT Filed: Sep. 2, 2011

(86) PCT No.: PCT/BE2011/000056

§ 371 (c)(1),
(2), (4) Date: Mar. 7, 2013

(87) PCT Pub. No.: WO2012/031340

PCT Pub. Date: Mar. 15, 2012

(65) Prior Publication Data

US 2013/0161218 A1 Jun. 27, 2013

(30) Foreign Application Priority Data

Sep. 8, 2010 (BE) ..... 2010/0534

(51) Int. Cl.
*B65D 19/44* (2006.01)

(52) U.S. Cl.
USPC ..... 108/55.3

(58) Field of Classification Search
USPC ..... 108/51.11, 51.3, 55.1, 55.3, 57.13; 206/454; 211/41.1, 41.14, 41.15
See application file for complete search history.

(56) References Cited

U.S. PATENT DOCUMENTS

| | | | | |
|---|---|---|---|---|
| 2,116,381 | A | 5/1938 | Burke | |
| 2,839,198 | A * | 6/1958 | Lefevre | 211/41.14 |
| 5,906,282 | A * | 5/1999 | Aldrich et al. | 211/41.14 |
| 6,360,676 | B1 * | 3/2002 | Schepers | 108/52.1 |
| 6,550,741 | B1 * | 4/2003 | Cottone | 248/678 |
| 7,264,126 | B1 * | 9/2007 | Bergeron | 211/41.14 |
| 7,980,397 | B2 * | 7/2011 | Noda et al. | 211/41.14 |
| 8,113,129 | B1 * | 2/2012 | Hurley et al. | 108/51.3 |
| 2003/0173314 | A1 * | 9/2003 | Knoll et al. | 211/41.14 |
| 2005/0120921 | A1 * | 6/2005 | Baechle et al. | 108/51.3 |

FOREIGN PATENT DOCUMENTS

| | | |
|---|---|---|
| BE | 1 015 082 A3 | 9/2004 |
| DE | 82 27 202 U1 | 1/1984 |
| DE | 83 17 944 U1 | 9/1984 |
| DE | 92 16 431 U1 | 5/1993 |
| EP | 1 394 058 A1 | 9/1984 |

OTHER PUBLICATIONS

International Search Report, dated Feb. 16, 2012, from corresponding PCT application.

* cited by examiner

*Primary Examiner* — Matthew Ing
(74) *Attorney, Agent, or Firm* — Young & Thompson

(57) ABSTRACT

Element for the storage, handling and transport of planar or primarily planar objects (33), that has an approximately rectangular shape with a length (L) and width (B) in the horizontal plane, that defines on its top two bearing surfaces (20) sloping inwards and two approximately perpendicular support surfaces (21) standing on them, whereby the support surfaces (21) together also define a ridge (23) that extends over the length (L) of the element (27, 29), the ridge (23) is in such a position that the two bearing surfaces (20) are of different sizes.

11 Claims, 8 Drawing Sheets

ELEMENT FOR THE STORAGE, TREATMENT AND TRANSPORT OF ARTICLES

The present invention relates to an element for the storage, handling and transport of objects.

In particular the invention relates to an element for the storage, handling and transport of fragile or easily damaged, primarily planar, objects such as windows, plates, tablets, tiles and similar, of whatever material such as natural stone, ceramic, glass, etc.

Such damage, whether a breakage or damage to a specific polished surface for example, or a certain decorative top coat for example, of course has to be avoided.

When such objects are stacked flat for storage, handling or transport, they are relatively vulnerable to impacts that can occur during transport or handling and to scratches that can occur by the objects sliding over one another.

This is particularly so, when stacking and unstacking objects, certainly when they are large and/or heavy, because during such an activity it is difficult to realise a purely vertical movement without any horizontal component.

The further down the objects are in the stack, the more vulnerable or breakable they are, as they have to take the weight of the stack of objects above.

Also when there are hard particles between the objects, for example sand grains or particles that have broken off the objects themselves, the risk of damage is particularly high.

In order to meet this problem, in BE 1.015.082 and EP 1.394.058 an element is revealed on which the said objects and other objects can be stored, handled and transported whereby the risk of damage is minimised.

This element consists of two bearing surfaces sloping inwards and two perpendicular support surfaces standing on them that together define a ridge. The planar objects are placed on the bearing surfaces, whereby they have an edge resting on a bearing surface and a flat side resting directly or indirectly against the support surface.

The revealed elements rest on the ground with practically their entire lower surface, or alternatively, with four supports extending over the length.

As a result their position is not stable, certainly on a somewhat uneven or dirty base.

The components of these elements also take up rather a lot of space, in the surface in which a forklift truck driver has to position the forks of his truck to be able to lift the element, whereby in the event of a collision damage easily occurs to the support edges or parts of the lower surface. This is undesirable both for reasons of strength and aesthetic reasons, as well as on account of the risk that people may be injured by splinters that can result from such a collision.

Also due to their construction method they have a relatively limited rigidity and thus deform relatively easily.

Such elements are also known in U.S. Pat. No. 2,116,381 and DE 8.227.202.

All known elements have the disadvantage that they consist of a large number of components, which makes the cost price relatively high.

Also, if the objects placed on the elements are larger than the elements, and thus protrude out, the objects interfere with the use of a manual pallet trolley whereby the movement of an element with objects on it becomes difficult.

It has also turned out that dirt, in the form of stone particles, sand, etc, can accumulate in the corner between a bearing surface and a support surface, whereby objects cannot be placed truly parallel to the support surface, due to the interference of the dirt, and thus are not well supported, or are placed on the edge that is underneath, and can still be damaged or fouled by the dirt. The first object that is placed on it is of course the most sensitive to this.

The purpose of the present invention is to provide a solution to at least one of the aforementioned and other disadvantages by providing an element for the storage, handling and transport of planar or primarily planar objects, that has a rectangular or approximately rectangular shape with a length and width in the horizontal plane, that defines on its top two bearing surfaces sloping inwards and two perpendicular or approximately perpendicular support surfaces standing on them, whereby the support surfaces together also define a ridge that extends over the length of the element, whereby the ridge is in such a position that the two bearing surfaces are of different sizes.

Such an element has advantages when complementary objects of different thicknesses have to be stored and transported.

This occurs for example with a stair cladding in natural stone. The cladding pieces that are fitted horizontally onto the steps are typically 3 cm thick, while the cladding pieces that are fitted vertically between the steps are typically 2 cm thick.

By storing and transporting the cladding pieces for a complete step on an element according to this preferred embodiment, the smaller of the two, the thin parts, can all be placed next to one another on one bearing surface, and the larger of the two, the thick parts, can be placed next to one another on the other bearing surface.

As a result the capacity of the element is increased, and a better view of what precisely is on the element is obtained, whereby the risk of loading errors is reduced.

A further advantage of storing and transporting objects, irrespective of their thickness, that protrude beyond the element, is that these asymmetric elements enable easier use of a pallet trolley, because the protruding parts are then next to the handle, which is also the rod with which the pump trolley is pumped up, whereby the pump trolley is less hampered by the objects placed on the element when the trolley is correctly positioned under the element.

In another aspect of the invention and a preferred embodiment, a transition between a support surface and a bearing surface is formed by a zone where the width of the ridge is at least one height less than the distance between the geometric extensions of the two support surfaces at this height, or by a recess in a bearing surface directly connected to the transition.

As a result there is less risk of damage to an object that is placed on the element due to the presence of dirt at the contact point of the bearing surface and the support surface.

In a further preferred embodiment, the transition between a support surface and a bearing surface is formed by a zone that consists of a vertical flat part between a bearing surface and a support surface.

The result of this is that the first object that is placed, and which rests against a support surface with a small part at the bottom, is clear of the ridge.

As a result it is prevented that the bottom edge of the first object is placed not close enough to the support surface, for example as a result of dirt, or as a result of a certain rounding that is practically inevitable from a production-technical point of view, whereby this object would not be supported over a large part of its length and a fissure could thus occur.

These ways for implementing the transitions between a support surface and a bearing surface have the said advantages irrespective of the position of the ridge, thus also if the ridge is in the middle and the bearing surfaces are of equal sizes.

In a further preferred embodiment, the element has precisely two support beams or rows of supports on the underside extending parallel to the ridge.

Such an element has the advantage that it is also stable on uneven bases.

A lot of space is also available for the forks of a forklift truck, since there only are two support beams, such that the risk of undesired contact between the forks and the element, and thus damage, is small.

In a further preferred embodiment the height of the support beams is larger than or equal to the difference between the height of the ridge and the height of the highest edge of the bearing surfaces.

As a result the elements can be stacked in a space-saving way, whereby the support beams of an overlying element rest on the highest edges of the bearing surfaces of an underlying element and the ridge of the underlying element lies in the space between the support beams of the overlying element.

This preferred embodiment can be further refined in an embodiment in which the underside of the element has two ledges or two rows of projections that define a base recess in between them, whereby the position, shape and format of the base recess correspond to the position, shape and format of the top of the ridge, and whereby the height of the ridge and the height of the base of the base recess are such that, when stacking elements, the ridge of an underlying element fits in the base recess of an overlying element.

This has the advantage that the combination of the ridge and ledges or rows of projections ensures that the stacked elements cannot move sideways when stacked. As a result a more stable and neater stack is obtained.

In another particular embodiment the element has an open structure and is primarily formed by at least two flat ribs that extend in the height and width of the element, which have bearing edges, support edges, feet, which respectively define bearing surfaces, support surfaces and support beams, and slat recesses, and which are connected to one another by slats at a distance from one another in the longitudinal direction of the element, and whereby a rib is placed at each end of the element.

This has advantages in that an element can be built up from a small number of uniform components, which reduces costs, while a sufficiently strong element is obtained.

The ribs can also be manufactured in an economically attractive way from sheet material, whereby thanks to the asymmetric position of the ridge, the components can be made out of sheet material with standard dimensions with less waste, and thus with less material consumption to manufacture such elements.

Preferably the ribs are at a distance of 40 cm. In this case an element with a length of 120 cm has four ribs, while an element of 200 cm has six ribs.

In a further preferred embodiment the ribs and slats are connected by a combination of two dowels and one screw in at least most of their connecting points.

This has the advantage that a more rigid connection is obtained than with screws alone, which is also cheaper than a connection with two or more screws, and can also be assembled simply without special skills or tools.

In a further aspect of the invention and in a further preferred embodiment, the element has breakage protection that consists of at least one bulge between one support beam or row of supports and the other support beam or row of supports, and which extends downwards from the element up to a distance from the plane defined by the underside of the support beams or rows of supports.

Hereby the bulge extends to the plane defined by the underside of the support beams or rows of supports when the load of the element exceeds a certain value.

During storage, and especially when experiencing impacts, for example during transport, an element without breakage protection can break relatively easily, which can lead to damage and/or loss of the objects placed on it.

By providing breakage protection in the form of a bulge on some or all of the ribs, which is poised just above the base on which the element stands when the element is unloaded or normally loaded, which means up to a maximum of a certain design value, the advantage of a stable positioning can be preserved, while in the event of static or impact overloads, the breakage protection can come into contact with the ground and can prevent bending that could lead to a breakage.

An alternative aspect of the invention is provided by the following clauses 1 to 5:

1. —Element for the storage, handling and transport of planar or primarily planar objects that have a rectangular or approximately rectangular shape with a length and width in the horizontal plane, which on its top defines two bearing surfaces sloping inwards and two perpendicular or approximately perpendicular support surfaces standing on them, whereby the support surfaces together also define a ridge that extends over the length of the element, whereby a transition between a support surface and a bearing surface is formed by a zone where the width of the ridge is at least one height smaller than the distance between the geometric extensions of the two support surfaces at this height or by a recess in a bearing surface directly connected to the transition.
2. —Element according to clause 1 whereby the transition between a support surface and a bearing surface is formed by a zone where the width of the ridge is at least one height less than the distance between the geometric extensions of the two support surfaces at this height, whereby the zone consists of a vertical flat part between a bearing surface and a support surface.
3. —Element according to any of the previous clauses whereby the element has precisely two support beams or rows of supports on the underside extending parallel to the ridge.
4. Element according to clause 3, whereby the element has an open structure and it is primarily formed by at least two flat ribs that extend in the height and width of the element, that have bearing edges, support edges, feet, which respectively also define bearing surfaces, support surfaces and support beams, and slat recesses, and which are connected to one another by slats at a distance from one another in the longitudinal direction of the element, whereby a rib is placed at each end of the element.
5. —Element according to clause 4, whereby the joint bearing edges of the ribs define the bearing surfaces and the joint support edges of the ribs and at least two connecting slats define the support surfaces.

A further alternative aspect of the invention is given by the following clauses 6 to 9:

6. —Element for the storage, handling and transport of planar or primarily planar objects that have a rectangular or approximately rectangular shape with a length and width in the horizontal plane, which on its top defines two bearing surfaces sloping inwards and two perpendicular or approximately perpendicular support surfaces standing on them, whereby the support surfaces together also define a ridge that extends over the length of the element, whereby on the underside the element has precisely two support beams or rows of supports extending parallel to the ridge, and whereby the element has breakage protection that consists of at least one bulge that is between one support beam or row of supports and the other support beam or row of supports, and which extends downwards from the element to a distance from the plane defined by the underside of the support beams or rows of supports.

7. —Element according to clause 6 whereby the bulge extends up to the plane defined by the underside of the support beams or rows of supports when the load of the element exceeds a certain value.

8. —Element according to clause 6 or 7 whereby the element has an open structure and that it is primarily formed by at least two flat ribs that extend in the height and width of the element, that have bearing edges, support edges, feet, which respectively also define bearing surfaces, support surfaces and support beams, and slat recesses, and which are connected to one another by slats at a distance from one another in the longitudinal direction of the element, whereby a rib is placed at each end of the element.

9. —Element according to clause 8, characterised in that the joint bearing edges of the ribs define the bearing surfaces and the joint support edges of the ribs and at least two connecting slats define the support surfaces.

With the intention of better showing the characteristics of the invention, a few preferred embodiments of an element according to the invention are described hereinafter by way of an example, without any limiting nature, with reference to the accompanying drawings, wherein:

FIG. 1 schematically shows in perspective an element according to the invention;

Figure 1:
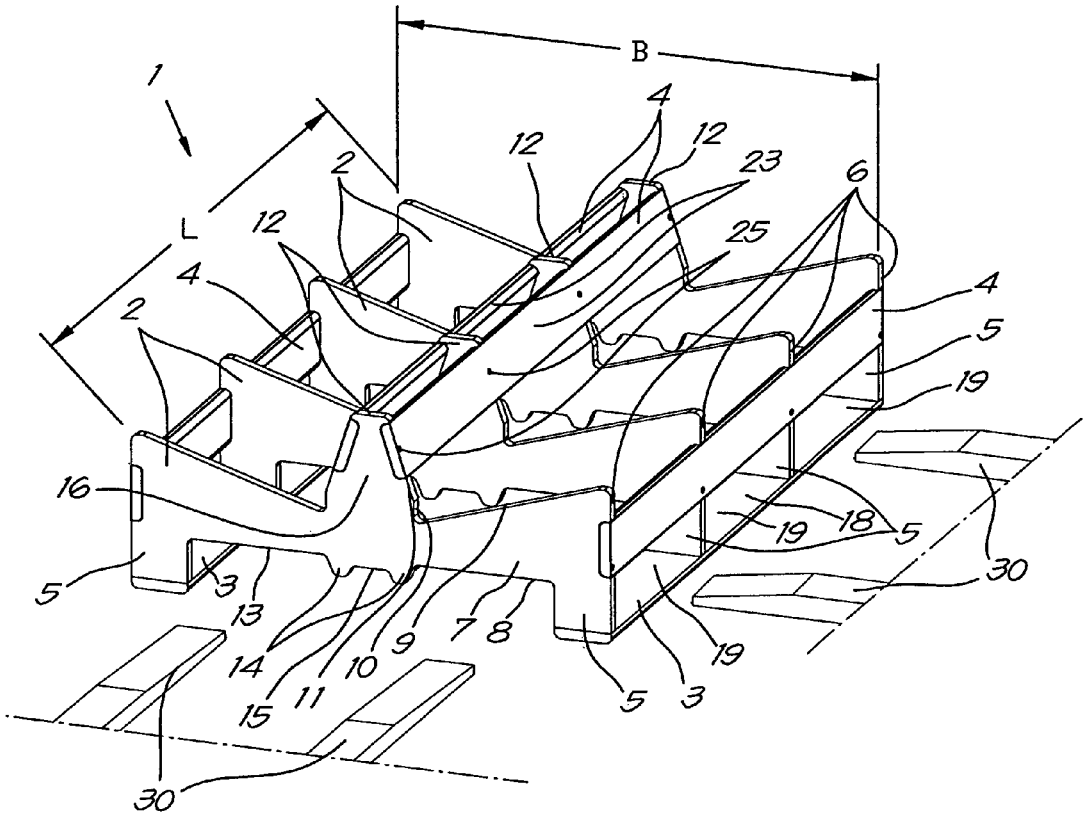
Figure 2:
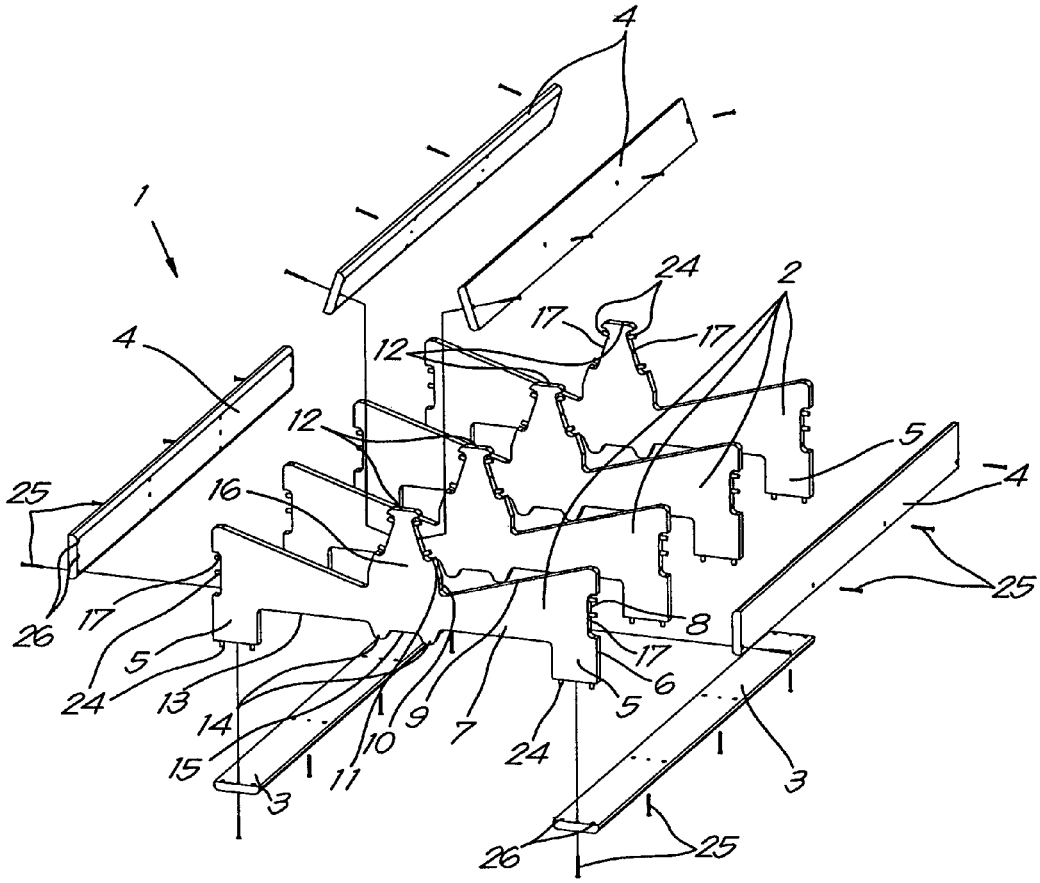
FIG. 2 shows the element of FIG. 1 giving an exploded view of the components.

FIGS. 1 and 2 show an element 1 with a length L and width B for the storage, handling and transport of primarily planar objects. The element 1 consists of four ribs 2 that are placed behind one another in the longitudinal direction, and connected together by six wooden slats extending in the longitudinal direction.

Two of these slats are base slats 3 that form the part of the element 1 resting on the ground. The other four slats are connecting slats 4.

A rib 2 is formed from a sheet of wood and has two feet 5 with a height Hs, two sides 6 with a height Hz, and a front and back 7 and 8. From the two sides 6 of the rib 2 a bearing edge 9 runs obliquely inwards and downwards.

Before the two bearing edges 9 touch one another, a vertical edge 10 runs upwards from the two bearing edges 9. From the vertical edges 10 support edges 11 run obliquely upwards and inwards, perpendicular to the bearing edge 9. Before the support edges 11 touch one another, they go into a horizontal top edge 12.

The underside of a rib 2 consists primarily of a horizontal base edge 13, on which two projections 14 and a lowered base 15 are present. The lowered base 15 has a height Hv.

The vertical edges 10, support edges 11 and top edge 12 define a ridge piece 16, that extends, upwards above the rest of the rib 2, and has a height Hr.

The projections 14 and lowered base 15 define a base recess that has a complementary shape to the ridge piece 16. Hv is equal to the difference between Hr and Hz.

A slat recess 17 is affixed in each of the sides 6 and support edges 11. There are thus 4 slat recesses 17 per rib 2.

The four connecting slats 4 that connect the four ribs 2 to one another are affixed in the slat recesses 17. The two base slats 3 are affixed in the longitudinal direction under the feet 5.

Through this composition of four ribs 2, which are placed at a distance of 40 cm from one another, and six slats 3,4, an element 1 is formed, which, seen from above, has a rectangular shape of length L and width B, whereby in this case L is equal to 120 cm. Similarly with six ribs 2 and longer slats 3,4 an element of 200 cm can be made.

Two open support beams 18 are defined at two edges of, the element 1 by the two rows of feet 5 and base slats 3. The support beams 18 extend in the longitudinal direction.

These support beams 18 have transverse openings 19, defined by two slats 3 and the ribs 2.

The bearing edges 9 define two bearing surfaces 20 sloping inwards. The support edges 11 with the connecting slats 4 that are affixed in the slat recesses 17 define two support surfaces 21.

On the underside of a support surface 21, the vertical edges 10 define a vertical flat part 22.

The ridge pieces 16, with the connecting slats affixed on them, define a central ridge 23 that runs over the length L of the element 1.

At each connecting point between the slats 3,4 and ribs 2, the connection is brought about by two dowels 24 and one screw 25. The dowels 24 are wooden pegs that fit tightly into holes 26.

Due to the tight fit, this gives a more secure connection than a screw 25 in the direction perpendicular to the longitudinal axis of the dowel 24. Through the combination of one screw 25 and two dowels 24 a rigid stiff element 1 is obtained at a low price.

Figure 5:
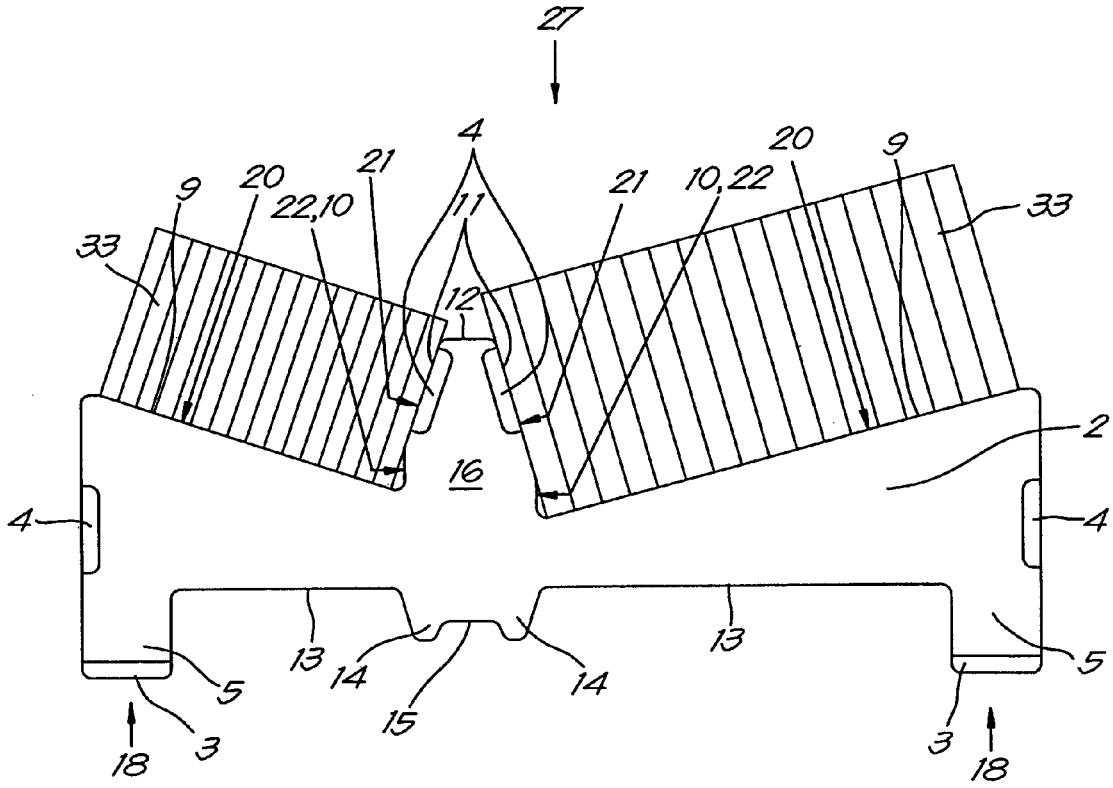
FIG. 5 shows a side view of a preferred embodiment of an element according to the invention, with objects placed on it.

FIG. 5 shows a specific preferred embodiment of an element according to the invention.

This is an element 27 such as the element 1 shown earlier, with the difference that the ridge 23, and thus the support surfaces 21, are not in the middle of the element 27. As a result the two bearing surfaces 20 are of different sizes.

Figure 6:
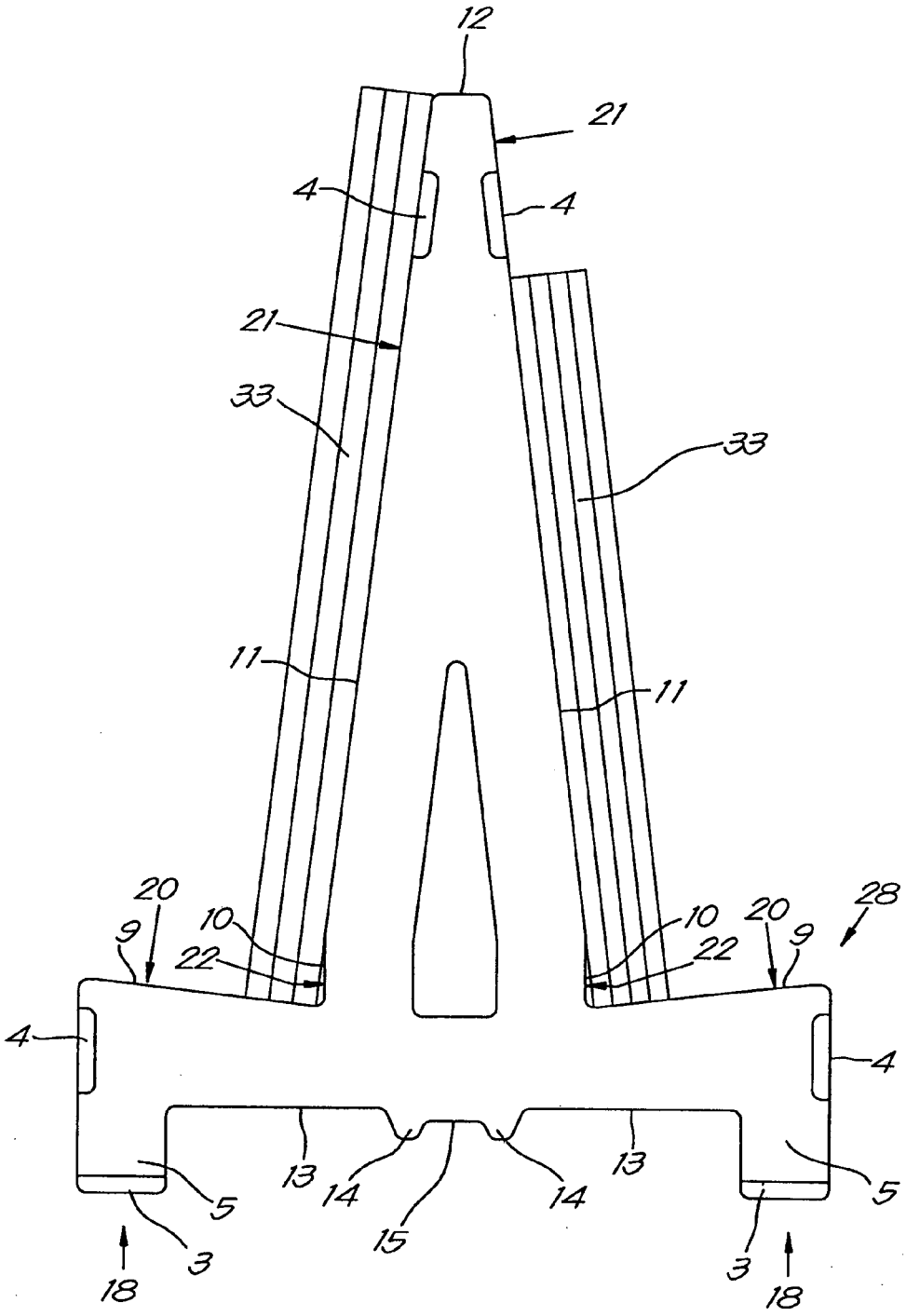
FIG. 6 shows an alternative embodiment of an element according to the invention with objects placed on it.

FIG. 6 shows an alternative embodiment of a variant 28 of an element according to the invention, in which the ridge 23 is higher than previously described, so that this element can be used for larger objects than the element 1 described earlier.

Figure 7:
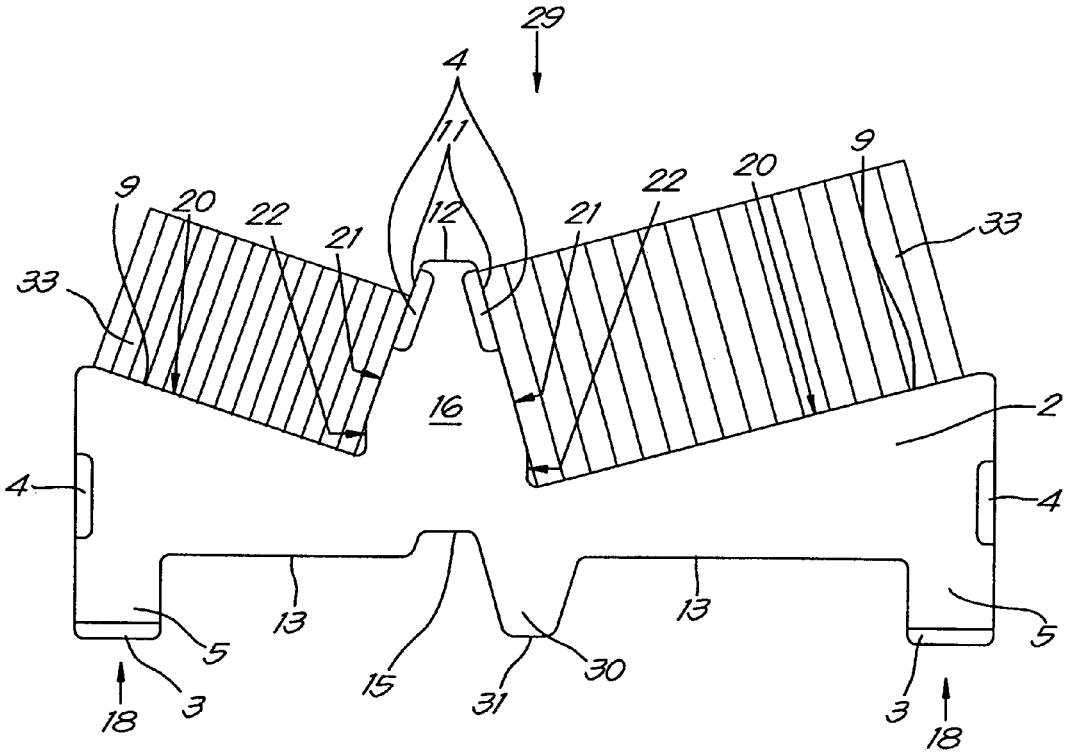
FIG. 7 shows a side view of a further preferred embodiment of an element according to the invention, with objects placed on it.

The element 29 according to the invention shown in FIG. 7 has breakage protection, which in this example is formed by a bulge 30 on the ribs 2.

This bulge 30 is such that its bottom edge 31, in situations in which the static design load of the element 29 is not exceeded, does not extend quite as far as the support beams 18, such that the edge 31 is a few millimeters above the surface on which the element 29 is standing. For clarity, FIG. 7 shows the distance between the edge 31 and the plane formed by the underside of the support beams on a much larger scale.

Only in the event of an overload, static or by impact, does the edge 31 come onto this surface, whereby the bulge 30 prevents the bending of the element 29 to the extent that it would lead to breakage.

Figure 8:
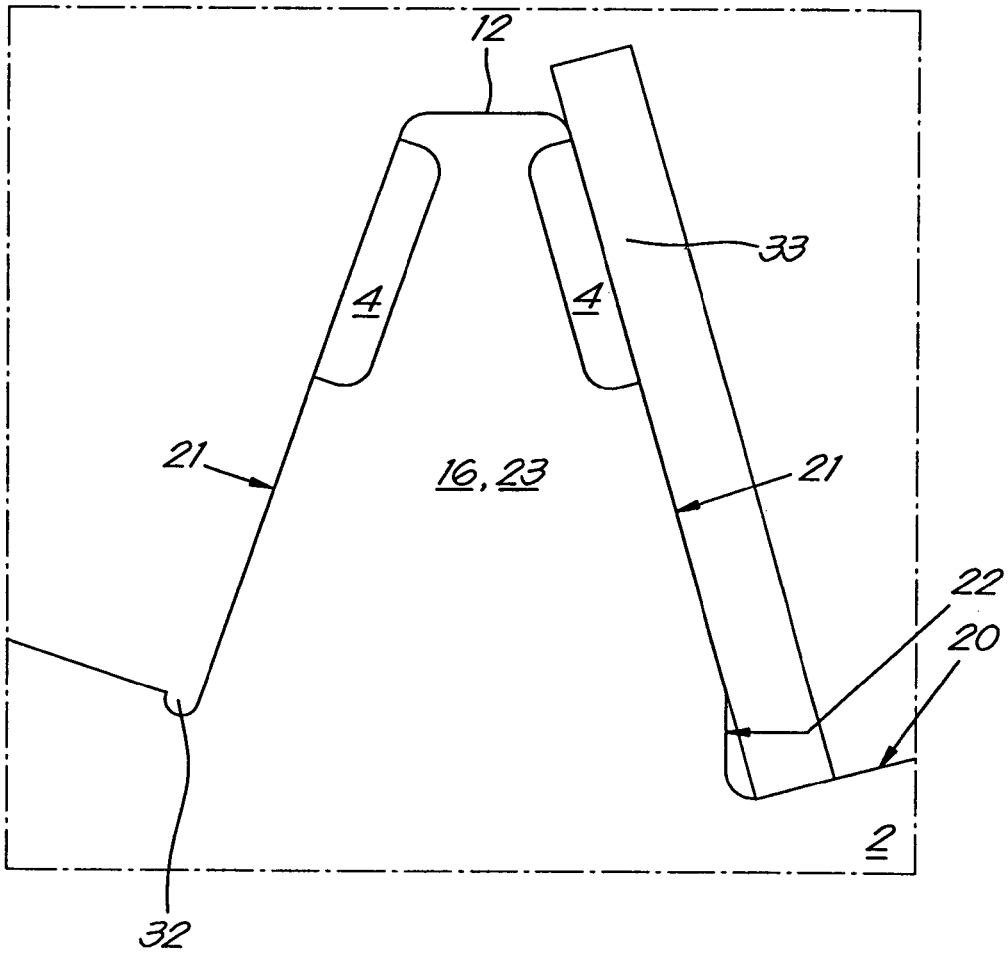
FIG. 8 shows a detail, as in FIG. 2, of a variant according to the invention of an element according to FIG. 7.

The detail of an element shown in FIG. 8 gives two possibilities for the transition between the support surface 21 and the bearing surface 20. The first possibility is the vertical flat part 22 already described on the underside of a support surface 21. An alternative to this is the affixing of a recess 32 in a bearing surface 20 at the transition with a support surface 21.

This recess 32 is preferably smaller than the smallest thickness of the objects for which the element is intended.

Figure 4:
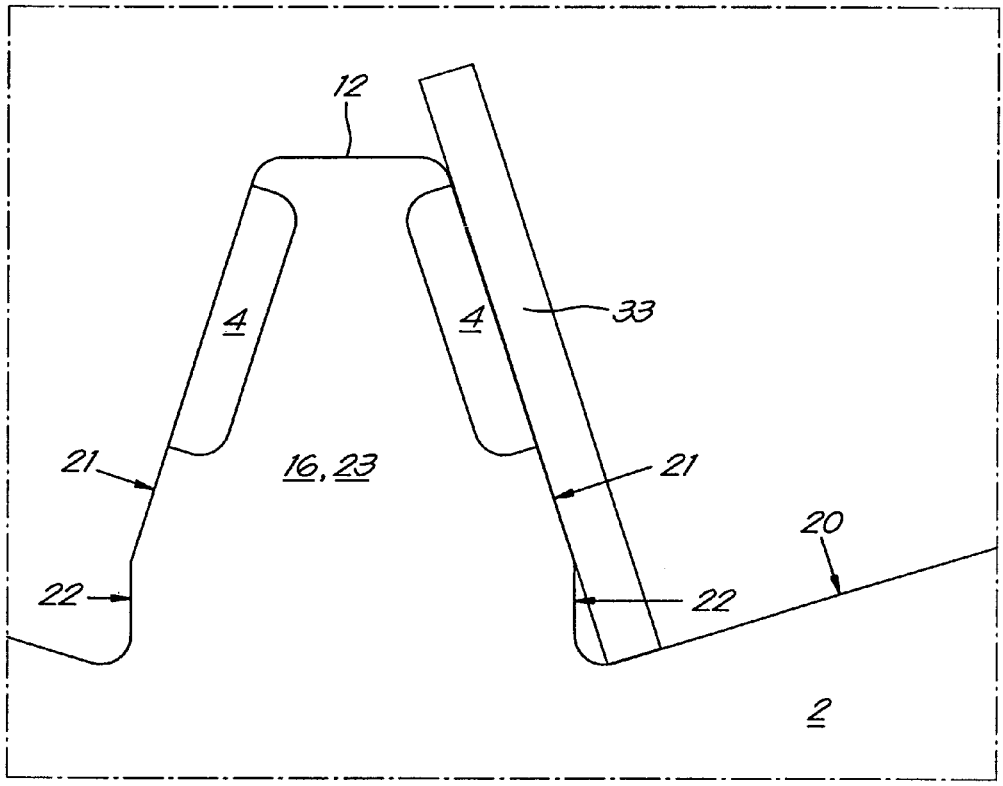
FIG. 4 shows a detail of an element designated by F4 in FIG. 3, on which an object is also placed.

The use of the elements 1, 27, 28, 29 according to the invention is simple and as follows, as shown in FIGS. 4 and 5.

Planar objects 33, for example plates of polished natural stone, are placed one by one with an edge on one of the bearing surfaces 20, whereby the flat sides of the objects 33 are parallel to the support surfaces 21 and directly or indirectly rest against them.

In this way, during placing there is no or only very limited sliding contact between the objects 33, such that the surface damage is limited.

As a result, thanks to the vertical flat part 22 the objects 33 can easily be placed with their lower edge close to the ridge 23, whereby they can rest flat against the support surface 21.

The element 1, 27, 28, 29 with objects 33 placed on it can be moved by a forklift truck, whereby access for the forks 30 is possible from both horizontal directions, in one direction between the support beams 8, in the other direction via the transverse openings 19.

Thanks to their supported storage method, the objects 33 are only slightly sensitive to damage during transport.

Also when removing the objects 33, this can be done without a sliding movement taking place between the objects 33.

The asymmetric element 27 is used to place complementary objects 33 of different formats on it, as shown specifically in FIG. 5.

Figure 3:
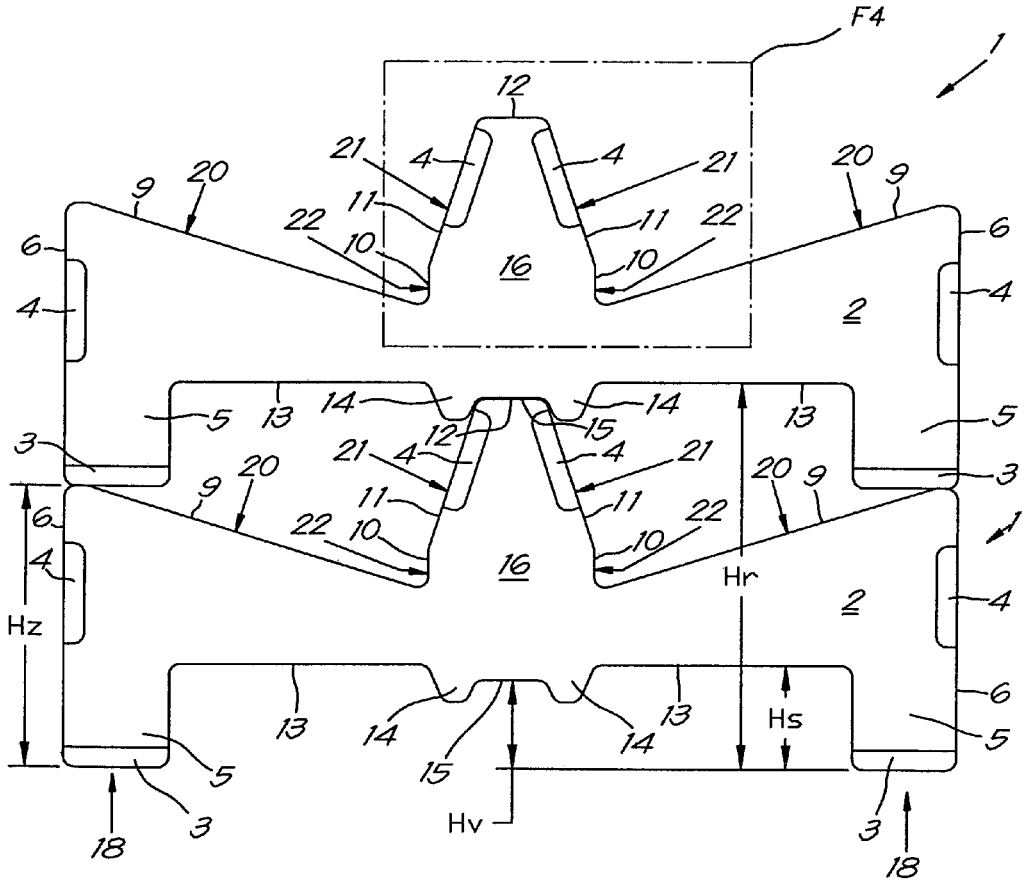
FIG. 3 shows a side view of a combination of two stacked elements according to FIG. 1.

When the elements 1, 27, 28, 29 cannot be used temporarily, they can be stacked firmly in a space-saving way, as shown in FIG. 3. The rows of projections 14 are thereby placed around the ridge 23, such that sideways movement is not possible.

It will be clear that the stackability of a high element 28 is limited. This can only be done on top of a small element 1.

Also the asymmetric elements 27, 29 cannot be stacked, or only to a limited extent, on or below the symmetric elements 1. However they can be stacked on one another without limit.

The support beams 18 do not necessarily need to be continuous edges over the entire length of the element 1, 27, 28, 29. Also a support beam interrupted in one or more places, or a row of individual supports or feet, can be used in certain circumstances with a sufficiently similar technical effect.

Although for many objects 33 it is sufficient for them to be borne by bearing edges 9 that together define a bearing surface 20 and are supported by support edges 11 and a slat 4, which together define a support surface 21, within the scope of the invention it is also possible to physically form the support surfaces 21 and bearing surfaces 20 by means of perforated sheet material or otherwise.

Optionally there can be protective material, for example film, between or around the objects 33 to better protect them.

The material of the elements 1, 27, 28, 29 is not limited to wood, but can also be different, for example plastic, metal, fibreboard, etc.

The present invention is by no means limited to the embodiments described as an example and shown in the drawings, but an element according to the invention can be realised in all kinds of variants, without departing from the scope of the invention.

The invention claimed is:

1. Element for the storage, handling and transport of planar objects, the element having, in the horizontal plane, a rectangular shape with a length and a width, the element comprising:

on an upper side two bearing surfaces sloping inwards and two support surfaces that are perpendicular to the bearing surfaces, wherein the support surfaces jointly at least partly define a ridge that extends along the length of the element, wherein a transition between an adjacent pair of one of said support surfaces and one of said bearing surfaces is formed by a zone where the width of the ridge is, at at least one height, smaller than the distance between geometric extensions of the two support surfaces at this height, or is formed by a recess in a bearing surface directly adjacent to the transition, wherein the element has precisely two support beams or rows of supports on an underside extending parallel to the ridge, and wherein the element has an open structure and is formed by at least two flat ribs that extend in the height and width of the element, the at least two flat ribs defining bearing edges, support edges, feet, said support surfaces, said support beams, and slat recesses, the at least two flat ribs being connected to one another by slats spaced at a distance from one another and extending in the longitudinal direction of the element, one of the at least two flat ribs being placed at each end of the element.

2. Element according to claim 1 wherein the transition is formed by the zone and the zone includes a vertical flat section.

3. Element according to claim 1, wherein the bearing edges of the ribs define the bearing surfaces and the support edges of the ribs and at least two connecting slats define the support surfaces.

4. Element for the storage, handling and transport of planar objects, the element having, in the horizontal plane, a rectangular shape with a length and a width, the element comprising on an upper side, two bearing surfaces sloping inwards and two support surfaces that are perpendicular to the bearing surfaces, wherein the support surfaces jointly at least partly define a ridge that extends along the length of the element, wherein the element has precisely two support beams or rows of supports on an underside extending parallel to the ridge, wherein the element has breakage protection that includes at least one bulge that is situated between one support beam or row of supports and the other support beam or row of supports, and which extends downwards from the element, wherein the bulge extends to a plane defined by an underside of the support beams or rows of supports at least when the load on the element exceeds a certain value, and wherein the element has an open structure and is formed by at least two flat ribs that extend in the height and width of the element, that have bearing edges, support edges, feet, said support surfaces, said support beams, and slat recesses, the at least two flat ribs being connected to one another by slats spaced at a distance from one another and extending in the longitudinal direction of the element, one of the at least two flat ribs being placed at each end of the element.

5. Element according to claim 4, wherein the bearing edges of the ribs define the bearing surfaces and the support edges of the ribs and at least two connecting slats define the support surfaces.

6. Element for the storage, handling and transport of planar objects, that has a rectangular shape with a length and width in the horizontal plane, that defines on its top two bearing surfaces sloping inwards and two perpendicular support surfaces standing on them, wherein the support surfaces together also define a ridge that extends over the length of the element, wherein the ridge is in such a position that the two bearing surfaces are of different sizes.

7. Element according to claim 6, wherein the element has two support beams on an underside extending parallel to the ridge, and wherein the height of the support beams is greater than or equal to the difference between the height of the ridge and the height of the highest edge of the bearing surfaces.

8. Element according to claim 7, wherein the underside of the element has two ledges or two rows of projections and a lowered base that defines a base recess in between, wherein the position, shape and format of the base recess corresponds to the position, shape and format of the top of the ridge, and wherein the height of the ridge and the height of the base of the base recess are such that when stacking plural ones of said element the ridge of an underlying said element lies in the base recess of an overlying said element.

9. Element according to claim 7, wherein the element has an open structure that is formed by at least two flat ribs that extend in the height and width of the element, that have bearing edges, support edges, feet, support surfaces, and said support beams, wherein said ribs have slat recesses and are connected together by slats spaced at a distance from one another and extending in the longitudinal direction of the element, wherein one of said at least two flat ribs is placed at each end of the element, and wherein the bearing edges of the ribs define the bearing surfaces and the support edges of the ribs and at least two connecting slats define the support surfaces.

10. Element according to claim 9, comprising at least six said slats, of which at least one is a component of each support surface, at least one is on the underside of each support beam, and at least one is on each side that is parallel to the ridge.

11. Element according to claim 9, wherein the ribs and slats are connected by a combination of at least one dowel and at least one screw in at least most of their connecting points.

* * * * *